US009662929B2

(12) United States Patent
Smith

(10) Patent No.: US 9,662,929 B2
(45) Date of Patent: May 30, 2017

(54) PAINTING ACCESSORY

(71) Applicants: Leonard John Smith, Bracken Ridge (AU); Janette Rosemary Smith, Bracken Ridge (AU)

(72) Inventor: Leonard John Smith, Bracken Ridge (AU)

(73) Assignees: Lenoard John Smith, Bracken Ridge (AU); Janette Rosemary Smith, Bracken Ridge (AU)

( * ) Notice: Subject to any disclaimer, the term of this patent is extended or adjusted under 35 U.S.C. 154(b) by 0 days.

(21) Appl. No.: 14/772,247

(22) PCT Filed: Feb. 26, 2014

(86) PCT No.: PCT/AU2014/000180
§ 371 (c)(1),
(2) Date: Sep. 2, 2015

(87) PCT Pub. No.: WO2014/134661
PCT Pub. Date: Sep. 12, 2014

(65) Prior Publication Data

US 2016/0001590 A1 Jan. 7, 2016

(30) Foreign Application Priority Data

Mar. 6, 2013 (AU) ..... 2013900803

(51) Int. Cl.
*B44D 3/12* (2006.01)

(52) U.S. Cl.
CPC ..... *B44D 3/128* (2013.01)

(58) Field of Classification Search
CPC ..... B44D 3/128
(Continued)

(56) References Cited

U.S. PATENT DOCUMENTS 3,329,307 A 7/1967 Jacobson
3,463,366 A 8/1969 Spencer
(Continued)

FOREIGN PATENT DOCUMENTS

AU 2006100475 A4 7/2006
WO WO-02/09953 2/2002

OTHER PUBLICATIONS

International Search Report and Written Opinion for PCT/AU2014/000180.

*Primary Examiner* — Robert J Hicks
*Assistant Examiner* — Kareen Thomas
(74) *Attorney, Agent, or Firm* — Honigman Miller Schwartz and Cohn LLP

(57) ABSTRACT

An accessory for a lever-lid can enables improved use of lever-lid cans. The accessory includes a sealing element including an axially extending annular protrusion and a lip, the lip and the annular protrusion defining an axially extending annular channel that shares a common axis with the annular protrusion. A body is formed adjacent to the sealing element, the body defining an aperture for providing access to contents of the lever-lid can. The annular protrusion is adapted to fit into a channel of the lever-lid can and provide a first seal against liquid entering the channel, and the lip is adapted to fit against an internal edge of the lever-lid can, the lip providing a second seal to prevent liquid entering the channel from an inside of the lever-lid can.

11 Claims, 5 Drawing Sheets

(58) Field of Classification Search
USPC ..... 220/695–702, 729, 730, 735, 736, 220/656–659
See application file for complete search history.

(56) References Cited

U.S. PATENT DOCUMENTS

| | | | | | |
|---|---|---|---|---|---|
| 3,469,735 | A * | 9/1969 | Burt | B65D 25/50 | 220/698 |
| 3,727,792 | A * | 4/1973 | Levin | B44D 3/128 | 220/695 |
| 3,980,213 | A | 9/1976 | Ramsay | | |
| 4,014,465 | A | 3/1977 | Ritter | | |
| 4,125,210 | A | 11/1978 | Embree | | |
| 4,203,537 | A | 5/1980 | McAlister | | |
| 4,893,723 | A | 1/1990 | Seabolt | | |
| 4,911,319 | A | 3/1990 | DeJean | | |
| 5,392,969 | A | 2/1995 | Usery | | |
| 5,662,242 | A | 9/1997 | Steo | | |
| 5,803,298 | A * | 9/1998 | Hausmann | B65D 43/0216 | 220/319 |
| 6,491,185 | B1 * | 12/2002 | Azzarello | B65D 43/0206 | 206/508 |
| D476,787 | S | 7/2003 | Templeton | | |
| 6,588,618 | B1 * | 7/2003 | Davis | B44D 3/127 | 220/254.7 |
| D489,611 | S | 5/2004 | Monsanty | | |
| D620,662 | S | 7/2010 | Blanchard | | |
| D633,676 | S | 3/2011 | Erdfarb | | |
| 8,418,870 | B2 * | 4/2013 | Song | B65D 43/0202 | 215/274 |
| 2005/0236443 | A1 | 10/2005 | Gringer et al. | | |
| 2006/0064843 | A1 | 3/2006 | Maria Cornelissen | | |

* cited by examiner

PAINTING ACCESSORY

FIELD OF THE INVENTION

The present invention relates to handling of liquids. In particular, although not exclusively, the invention relates to a painting accessory.

BACKGROUND TO THE INVENTION

Paint, as well as varnishes, glues and other similar liquids, often come in lever lid cans, commonly referred to as paint tins. In some circumstances it is desirable to access the liquid directly from the tin, whereas in other circumstances it is more desirable to pour the liquid into another container, such as a smaller bowl or a roller tray.

FIG. 1 illustrates a paint tin 100, also commonly called a paint can, according to the prior art. The paint tin 100 comprises a body 105 that is generally cylindrical in shape, to which a lid (not shown) can be removably fitted. This enables the paint tin 100 to be resealed, preventing its contents from spoiling or drying out.

The body 105 includes an upper rim 110, the upper rim 110 including an annular channel 115, in which an annular protrusion of the lid snugly fits. The annular protrusion of the lid thus creates a seal against the annular channel 115, preventing paint from spilling from the tin 100 or drying out in the tin 100.

When painting directly from the paint tin 100 using a paint brush, it is desirable to remove excess paint from the paint brush, to avoid dripping and spillage from the brush. Accordingly, the paint brush is typically scraped against an inner edge of the upper rim 110, adjacent to the annular channel 115, such that excess paint is forced back into the paint tin 100.

A problem with scraping the brush against the inner edge of the upper rim 110 is that paint invariably comes in contact with the annular channel 115 and settles therein. If the lid is reapplied while the paint is still wet, the paint can act as a glue as it dries, making later removal of the lid difficult. If, on the other hand, the paint dries in the annular channel 115, it is more difficult to refit the lid and a correct seal cannot be provided. The paint will thus quickly dry out and spoil.

As discussed above, in many cases it is desirable to pour paint from the paint tin 100 into another container. Paint tins 100 can contain 4 liters of paint, or even 10 L of paint, which is often too much paint to use in a single painting session. Additionally, a full paint tin 100 can be heavy and difficult to manage. Furthermore, paint rollers generally require access to paint in a roller tray, rather than directly from a paint tin 100.

When pouring paint from the paint tin 100, paint travels up an inner wall 120 of the paint tin 100, over the rim 110 and annular channel 115, and out of the tin 100. At completion of the pour, paint typically drips down an outer wall 125 of the tin 100, as well as settling in the annular channel 115.

As paint drips down the side of the tin, it becomes messy, and any label on the tin becomes difficult to read. This is particularly problematic for custom mixed paints, where a paint code is recorded on a side of the tin. Similarly, as paint settles in the annular channel 115, the lid can be difficult to refit, as discussed earlier.

Accordingly, there is a need for an improved painting accessory.

OBJECT OF THE INVENTION

It is an object of some embodiments of the present invention to provide consumers with improvements and advantages over the above described prior art, and/or overcome and alleviate one or more of the above described disadvantages of the prior art, and/or provide a useful commercial choice.

SUMMARY OF THE INVENTION

According to one aspect, the invention resides in an accessory for a lever-lid can, the accessory including:

a sealing element including an axially extending annular protrusion and a lip, the lip and the annular protrusion defining an axially extending annular channel that shares a common axis with the annular protrusion; and a body, formed adjacent to the sealing element, the body defining an aperture for providing access to contents of the lever-lid can;

wherein the annular protrusion is adapted to fit into a channel of the lever-lid can and provide a first seal against liquid entering the channel, and the lip is adapted to fit against an internal edge of the lever-lid can, the lip providing a second seal to prevent liquid entering the channel from an inside of the lever-lid can.

Preferably, the accessory further comprises a pouring element, extending outwards from a periphery of the body.

Preferably, the pouring element extends upwards from the body.

Preferably, the accessory further comprises a paint scraping element, for scraping excess paint off a paint brush, the paint scraping element forming at least part of an edge of the aperture.

Preferably, the paint scraping element comprises a curved edge.

Preferably, the paint scraping element forms between 30% and 60% of an edge of the aperture.

Preferably, the accessory further comprises a skirt, configured to extend downwards along a side of the lever-lid can.

Preferably, the skirt is configured to extend over between 5% and 20% of a height of the lever-lid can.

Preferably, the skirt comprises a plurality of tabs or cut-outs for assisting in removal of the accessory from the lever-lid can.

Preferably, the accessory is integrally formed.

Preferably, the accessory is formed of moulded resin.

BRIEF DESCRIPTION OF THE DRAWINGS

To assist in understanding the invention and to enable a person skilled in the art to put the invention into practical effect, preferred embodiments of the invention are described below by way of example only with reference to the accompanying drawings, in which.

Figure 1:
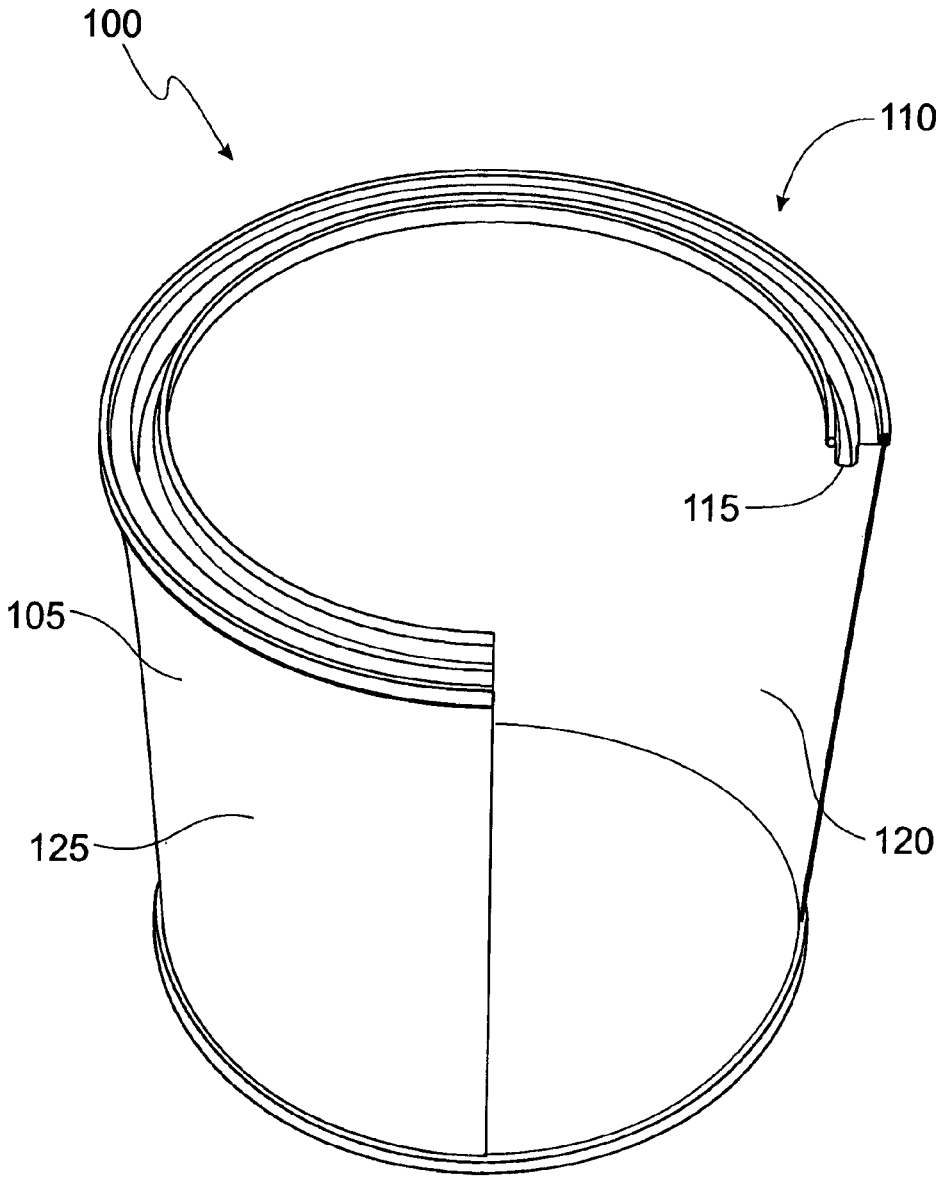
FIG. 1 illustrates a paint tin, according to the prior art.

Those skilled in the art will appreciate that minor deviations from the layout of components as illustrated in the drawings will not detract from the proper functioning of the disclosed embodiments of the present invention.

DETAILED DESCRIPTION OF THE INVENTION

Embodiments of the present invention comprise accessories for lever-lid cans. Elements of the invention are illustrated in concise outline form in the drawings, showing only those specific details that are necessary to the understanding of the embodiments of the present invention, but so as not to clutter the disclosure with excessive detail that will be obvious to those of ordinary skill in the art in light of the present description.

In this patent specification, adjectives such as first and second, left and right, front and back, top and bottom, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention.

According to one aspect, the invention resides in an accessory for a lever-lid can, the accessory including: a sealing element including an axially extending annular protrusion and a lip, the lip and the annular protrusion defining an axially extending annular channel that shares a common axis with the annular protrusion; and a body, formed between edges of the sealing element, the body defining an aperture for providing access to contents of the lever-lid can; wherein the annular protrusion is adapted to fit into a channel of the lever-lid can and provide a first seal against liquid entering the channel, and the lip is adapted to fit against an internal edge of the lever-lid can, the lip providing a second seal to prevent liquid entering the channel from an inside of the lever-lid can.

Advantages of some embodiments of the present invention include an ability to access liquid in a clean manner, and maintain a seal on a lever-lid can such as a paint tin.

Certain embodiments of the present invention enable paint to be poured from the tin, without dripping down a side of the tin, or settling in a channel of the tin, thus preventing correct reapplication of the lid.

Furthermore, certain embodiments of the present invention enable paint to be accessed directly from the tin, by a brush, while preventing paint settling in the channel of the tin. Paint can be scraped back into the tin, reducing spillage and wastage.

According to certain embodiments, the painting accessory is reusable, easy to clean, lightweight and robust, and can be removed and refitted with minimal effort.

Figure 2:
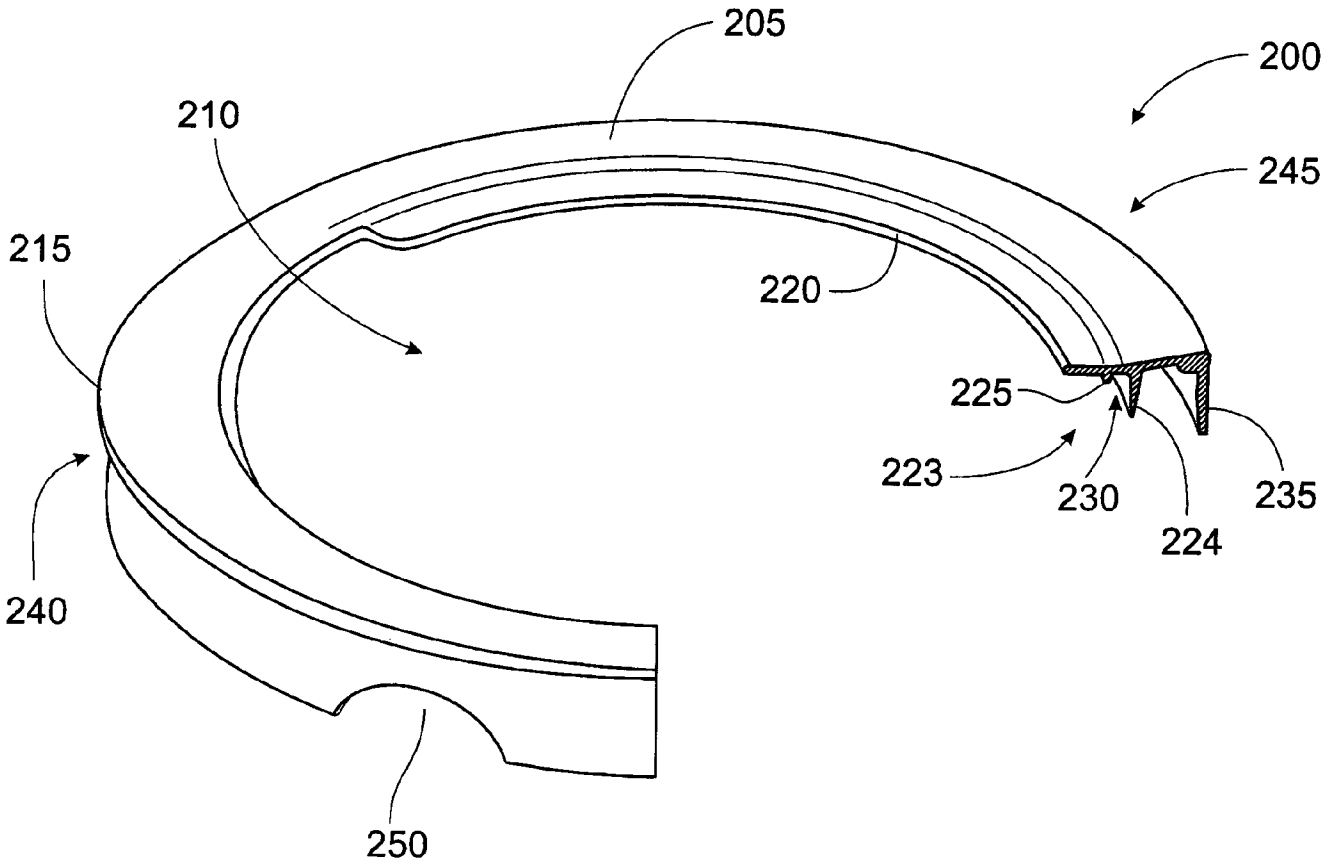
FIG. 2 illustrates a perspective cutaway view of a painting accessory, according to an embodiment of the present invention.

FIG. 2 illustrates a perspective cutaway view of a painting accessory 200, according to an embodiment of the present invention. The painting accessory 200 is adapted to fit onto and protect a lever-lid can such as the paint tin 100 of FIG. 1. For the sake of clarity, the painting accessory 200 will be described with reference to the paint tin 100, however, as will be understood by the skilled addressee, the painting accessory 200 can be used with other types of lever-lid cans and with lever-lid cans of various shapes and sizes.

The painting accessory 200 includes a body 205 that defines an aperture 210 for both accessing paint in the paint tin 100 for painting, and for pouring paint from the paint tin 100. The aperture 210 is thus of sufficient size to receive an end of a brush, and where the painting accessory 200 is adapted to suit large paint tins 100, sufficiently large to provide access for a user's hand while holding a paint brush.

The painting accessory 200 includes a pouring element 215, a paint scraper 220 and a friction seal 223. In combination, these features enable paint to be poured from the paint tin 100, and direct access with a brush, while protecting the upper rim 110 of the paint tin 100.

The friction seal 223 includes an axially extending annular protrusion 224 that fits into the annular channel 115 of the paint tin 100, and a lip 225, adapted to fit around an inner top edge of the paint tin 100, and extend downwards into the paint tin 100. The annular protrusion 224 and the lip 225 define an axially extending annular channel 230 that shares a common axis with the annular protrusion 224.

The annular protrusion 224 and the lip 225 work together to create a frictional seal to provide sufficient grip between the paint tin 100 and the painting accessory 200, and to prevent paint from flowing up against or into the annular channel 115 of the paint tin 100. According to some embodiments, the frictional seal is particularly important when paint is poured, to prevent the painting accessory 200 from partially or fully dislodging from the paint tin 100.

The painting accessory 200 extends over an edge of the paint tin 100, and down a side of the paint tin 100, forming a skirt 235 that fits around a periphery of the paint tin 100 and against an outside of the tin 100. The skirt 235 protects the annular channel 115 of the paint tin 100 from paint from an outside of the tin, and provides strength and rigidity to the painting accessory 200. The skirt 235 thus prevents deformation of the pouring element 215 and other parts of the painting accessory 200.

The skirt 235 advantageously comprises 5%-20% of a height of the paint tin 100, however if a handle is present on the paint tin, the skirt 235 should be sufficiently short so as to not interfere with the paint handle.

According to certain embodiments, the painting accessory 200 is configured such that pressure is applied on only a portion of the tin 100 by the skirt 235. According to some embodiments, such a configuration provides an adequate seal, while enabling easy removal of painting accessory 200.

The pouring element 215 is located on a first side 240 of the painting accessory 200, and enables paint to be poured from the paint tin 100 without spilling the paint down a side of the paint tin 100, and without dripping. In one embodiment, for example, the pouring element 215 extends from the skirt 235 approximately 8 mm, and tapers inwards towards the skirt 235.

The pouring element 215 is angled upwards such that paint on the pouring element 215 flows back into the paint tin 100 when placed on a level surface. This prevents paint dripping onto an outside of the paint tin 100 after a pour.

As discussed above, the paint scraper 220 defines a side of the aperture 210. The paint scraper 220 is placed on a second side 245 of the painting accessory 200, the second side 245 opposite the first side 240. The paint scraper 220 forms approximately 50% of an edge of the aperture 210. Advantageously, according to some embodiments, the paint scraper 220 forms between 30% and 60% of an edge of the aperture 210.

The paint scraper 220 is of sufficient width to prevent surplus liquid on a top of the paint scraper 220 from reaching an edge of the painting accessory 200. Additionally, the paint scraper 220 is advantageously lower than the body 105 of the painting accessory, to prevent paint flowing from the paint scraper 220 to the body.

According to certain embodiments, an upper surface of the paint scraper 220 has a mild downwards incline towards the aperture 210, to prevent paint from running back over a top of the painting accessory.

The painting accessory 200 further includes a plurality of crescent cut-outs 250 to assist in removal of the device. The number of crescent cut-outs 250 can vary based on a size of the painting accessory 200, with fewer crescent cut-outs 250 needed for smaller painting accessories 200.

The crescent cut-outs 250 enable easy removal of the painting accessory 200 through application of upward finger pressure to a bottom of each or some of the plurality of crescent cut-outs 250, thus providing even upward pressure to the painting accessory 200 relative to the paint tin 100. The crescent cut-outs 250 are located on opposing sides of the painting accessory 200, and away from the pouring element 215. As will be readily understood by the skilled addressee, the crescent cut-outs 250 can vary in shape, position and location, based on production requirements.

Figure 3:
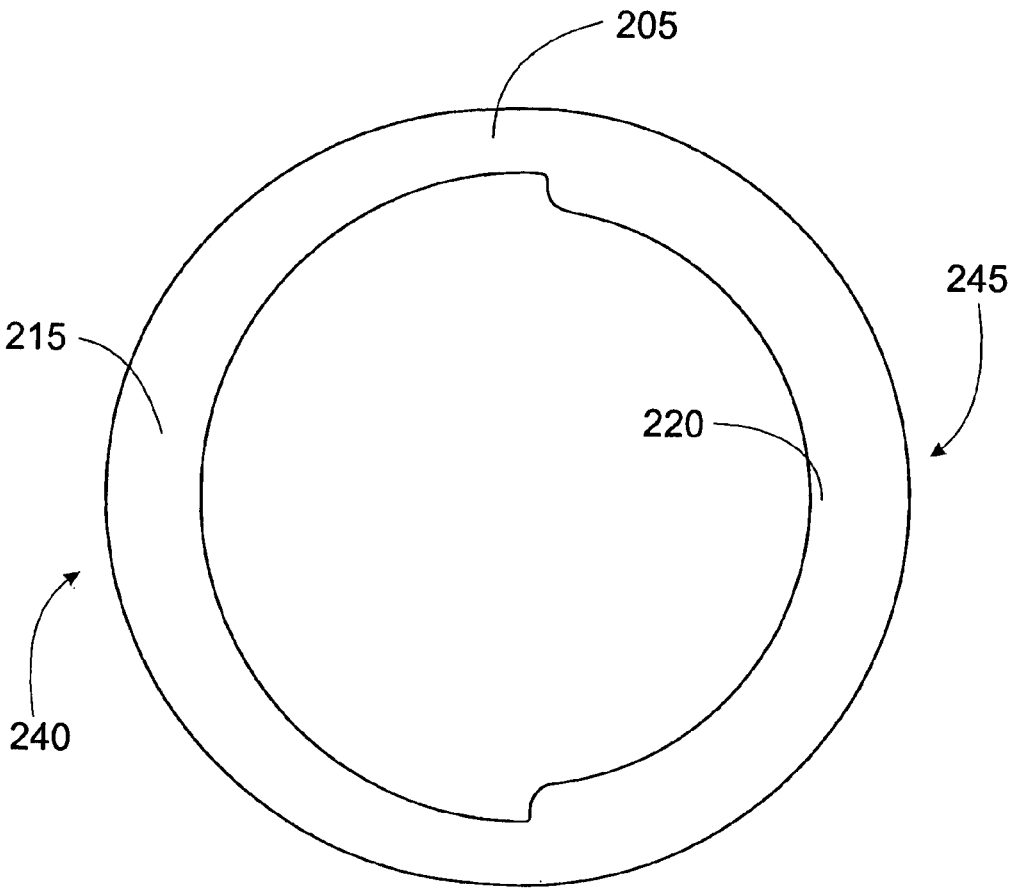
FIG. 3 illustrates a top view of the painting accessory of FIG. 2.

FIG. 3 illustrates a top view of the painting accessory 200, according to an embodiment of the present invention.

The crescent cut-outs 250 are placed in pairs on opposing sides of the painting accessory 200, to enable a user's finger and thumb to simultaneously push upwards on a pair of the cut-outs 250.

The painting accessory comprises substantially flat upper surfaces, to prevent paint or other liquid from settling in any grooves or channels.

Figure 4:
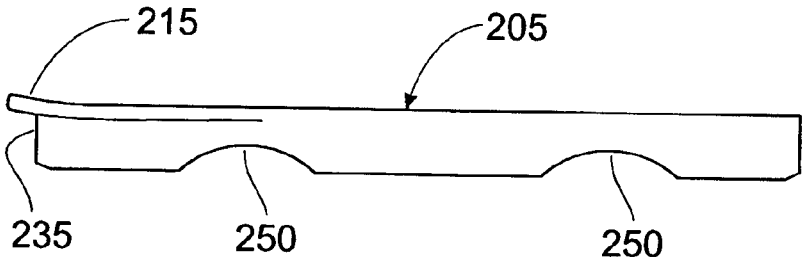
FIG. 4 illustrates a side view of the painting accessory of FIG. 2.

FIG. 4 illustrates a side view of the painting accessory 200, according to an embodiment of the present invention. As discussed above, the pouring element 215 extends upwardly and outwardly from the skirt 235. This forces liquid, such as paint, on the pouring element 215 to flow towards the aperture 210, and back into the paint tin 100.

Furthermore, the crescent cut-outs 250 can be replaced by tabs (not shown) having substantially flat surfaces to which upward pressure can be applied to remove the painting accessory 200 from the tin 100. The tabs can also include vertical gussets for supporting the flat surfaces and providing strength and rigidity to the tabs.

Figure 5:
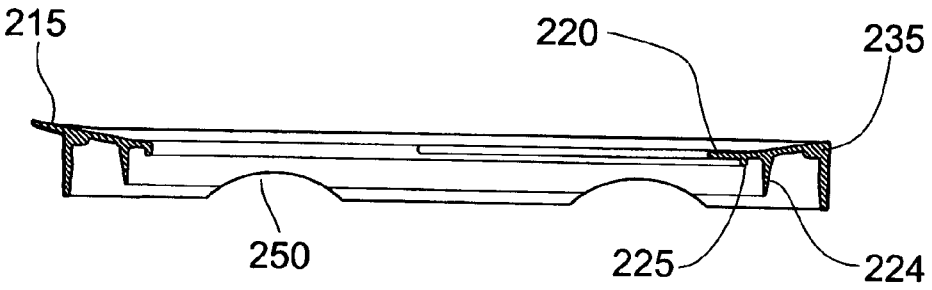
FIG. 5 illustrates a side cross sectional view of the painting accessory of FIG. 2.

FIG. 5 illustrates a side cross sectional view of the painting accessory 200, according to an embodiment of the present invention.

As best illustrated by FIG. 5, the paint scraper 220 is lower than the body 205, to prevent paint from flowing from the paint scraper 220 to the body 205.

Furthermore, as discussed above, the axially extending annular protrusion 224, the lip 225 and the skirt 235 work together to prevent paint from entering a channel 115 of a paint tin 100. The annular protrusion 224 provides direct protection for the channel 115, and the lip 225 and the skirt 235 provide a secondary seal from an inside and an outside of the tin 100 respectively. The secondary seal prevents paint from building up against the channel 115, which can drip into the channel 115 upon removal of the painting accessory 200.

Figure 6:
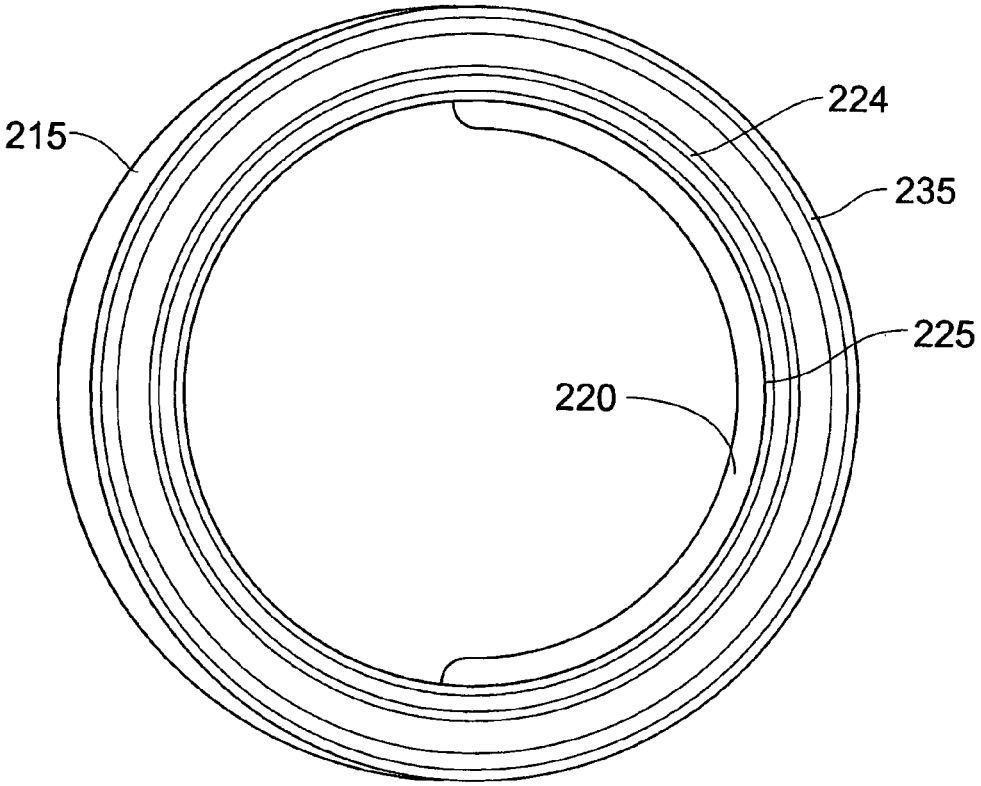
FIG. 6 illustrates a bottom view of the painting accessory of FIG. 2.

FIG. 6 illustrates a bottom view of the painting accessory 200, illustrating the annular protrusion 224, the lip 225 and the skirt 235, as well as the pouring element 215 and the paint scraper 220.

Figure 7:
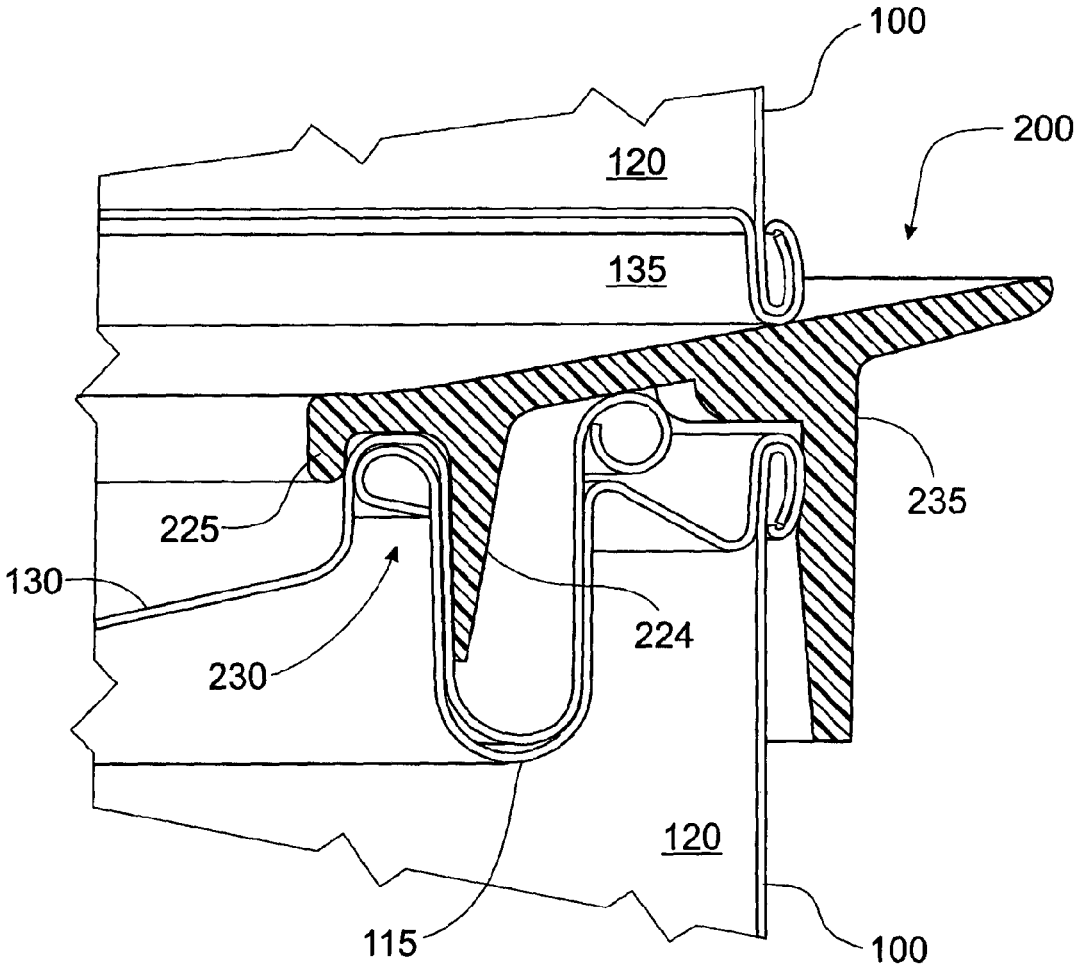
FIG. 7 illustrates a side sectional view of the painting accessory of FIG. 2 installed on a first paint tin having a lid in place and on top of which is stacked a second paint tin.

FIG. 7 illustrates a side sectional view of the painting accessory 200 installed on a first paint tin 100 having a lid 130 in place. A bottom rim 135 of a second paint tin 100 is shown stacked on top of the first paint tin 100. A polymer surface of the body 205 of painting accessory provides an excellent non-slip surface keeping stacked paint tins 100 vertically aligned. Further, by storing a painting accessory 200 on the top of a closed paint tin 100, the accessory 200 is immediately and conveniently available for use when the tin 100 is opened by removing the lid 130.

The painting accessory 200 is advantageously integrally formed of moulded resin. However, as will be readily understood by the skilled addressee, any suitable material can be used.

In summary, advantages of some embodiments of the present invention include an ability to access liquid in a clean manner, and maintain a seal on a lever-lid can such as a paint tin.

Certain embodiments of the present invention enable paint to be poured from the tin, without dripping down a side of the tin, or settling in a channel of the tin and preventing correct reapplication of the lid.

Furthermore, certain embodiments of the present invention enable paint to be accessed directly from the tin, by a brush, while preventing paint settling in the channel of the tin. Paint can be scraped back into the tin, reducing spillage and wastage.

Certain embodiments of the present invention enable paint to be poured from the tin, without soiling the channel of the tin or otherwise preventing correct refitting of the lid.

According to certain embodiments, the painting accessory is reusable, easy to clean, lightweight and robust, and can be removed and refitted with minimal effort.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the above described invention.

The invention claimed is:

1. An accessory for a lever-lid can, the accessory comprising:

a sealing element including an axially extending annular protrusion and a lip, the lip and the annular protrusion defining an axially extending annular channel that shares a common axis with the annular protrusion; and a body, formed adjacent to the sealing element, the body defining an aperture for providing access to contents of the lever-lid can, wherein the annular protrusion comprises a wedge-shaped cross section defined by corresponding substantially flat planar surfaces and is configured to fit into a channel of the lever-lid can and provide a first seal against liquid entering the channel, and the lip defines a corresponding substantially flat planar surface configured to fit against an internal edge of the lever-lid can, the lip providing a second seal to prevent liquid entering the channel from an inside of the lever-lid can, and wherein the annular channel defined by the lip and the annular protrusion defines a substantially rectangular shaped cross section.

2. The accessory of claim 1, further comprising a pouring element, extending outwards from a periphery of the body.

3. The accessory of claim 1, further comprising a pouring element extending upwards from the body.

4. The accessory of claim 1, further comprising a paint scraping element, for scraping excess paint off a paint brush, the paint scraping element forming at least part of an edge of the aperture.

5. The accessory of claim 4, wherein the paint scraping element comprises a curved edge.

6. The accessory of claim 4, wherein the paint scraping element forms between 30% and 60% of the edge of the aperture.

7. The accessory of claim 1, further comprising a skirt disposed on the sealing element and configured to extend downwards along a side of the lever-lid can.

8. The accessory of claim 7, wherein the skirt is configured to extend over between 5% and 20% of a height of the lever-lid can.

9. The accessory of claim 7, wherein the skirt comprises a plurality of tabs or cut-outs for assisting in removal of the accessory from the lever-lid can.

10. The accessory of claim 1, wherein the accessory is integrally formed.

11. The accessory of claim 1, wherein the accessory is formed of moulded resin.

* * * * *